United States Patent [19]

Turner

[11] 4,317,427

[45] Mar. 2, 1982

[54] CARRIER FOR ROTATABLY HOLDING KINESCOPE FACEPLATE DURING PROCESSING

[75] Inventor: Clarence C. Turner, Marion, Ind.

[73] Assignee: RCA Corporation, New York, N.Y.

[21] Appl. No.: 164,686

[22] Filed: Jun. 30, 1980

[51] Int. Cl.[3] ..... B05C 11/14

[52] U.S. Cl. ..... 118/503; 118/52; 279/110; 279/118; 279/123; 279/1 SJ

[58] Field of Search ..... 118/52, 503, 55; 427/240; 279/1 SJ, 1 Q, 1 L, 110, 118, 123; 81/3.43

[56] References Cited

U.S. PATENT DOCUMENTS

| | | | |
|---|---|---|---|
| 473,764 | 4/1892 | Little | 81/3.43 |
| 866,788 | 9/1907 | Holstein | 279/110 |
| 2,356,946 | 8/1944 | Powers | 118/52 |
| 2,678,218 | 5/1954 | Oslund | 279/110 |
| 2,686,058 | 8/1954 | Zetterberg | 279/110 |
| 3,376,153 | 4/1968 | Fiore | 118/52 |
| 3,494,626 | 2/1970 | Curko | 279/66 |
| 3,834,613 | 9/1974 | Hankey | 118/52 |

*Primary Examiner*—Norman Morgenstern
*Assistant Examiner*—Richard Bueker
*Attorney, Agent, or Firm*—Eugene M. Whitacre; Glenn H. Bruestle; Lester L. Hallacher

[57] ABSTRACT

A rotatable carrier for holding kinescope faceplates during processing includes a support plate having radially extending retention slots. Object retainers are arranged to slide in the slots and hold the object being processed. The retainers are biased outwardly away from the axis of rotation by biasing means. A tensioning band urges the retainers inwardly toward the axis of rotation so that centrifugal force acts against the tensioning bands rather than the springs.

5 Claims, 3 Drawing Figures

CARRIER FOR ROTATABLY HOLDING KINESCOPE FACEPLATE DURING PROCESSING

BACKGROUND OF THE INVENTION

This invention relates generally to carriers for holding objects during processing and particularly to a rotatable carrier for holding kinescope faceplates during the application of the phosphors.

During the application of phosphors to the inside surface of kinescope faceplates the faceplates are held in rotatable carriers during movement between the various stations of a processing line. The faceplates remain in the carrier and move along the processing line while the various steps of the processing are performed at each of the stations. As an example, initially the faceplates are placed into carriers and are cleaned and dried at the beginning of the processing line. The faceplates move to the next station where a photosensitive aqueous slurry of one of the three color phosphors needed for color television is applied to the inside of the faceplate. Typically, in order to get a uniform coating of phosphor the faceplate is rotated and the phosphor slurry flows over the entire internal surface. The faceplate then advances to subsequent stations where the phosphor slurry is dried and otherwise processed. The faceplates are next removed from the processing line and exposed to light so that a selected portion of dried photosensitive phosphor slurry is exposed to the light. The faceplates are next put into carriers along another processing line and washed and dried to leave the desired pattern of phosphor. The processing steps are then repeated for another of the three colors of phosphor.

All kinescopes must go through the same processing steps irrespective of size and it, therefore, is preferable to have faceplates of all sizes processed along the same line. However, faceplates of different sizes require carriers of different sizes and consequently there is a need for a carrier which can be quickly removed from the line at one of the stations where the carrier does not rotate without shutting down the entire processing line. Also, because the faceplates rotate during some of the processing steps, it is necessary for the carriers to firmly hold the faceplates without dropping them while simultaneously applying a controlled pressure to avoid crushing them. The invention is directed to a rotatable carrier which fulfills these requirements.

SUMMARY

A carrier for holding objects being rotated during processing includes a slotted support plate. The slots are substantially perpendicular to and spaced about the axis of the rotation of the support plate. Object retention means are slidably arranged in the slots to slide substantially parallel to the plane of the support plate. Arranged between the support plate and the retention means are biasing means which bias the retention means outwardly away from the axis of rotation. Tensioning means urge the retention means against the biasing means toward the axis of rotation so that an object being processed is firmly held and centrifigal force acts against the tensioning means.

DETAILED DESCRIPTION OF THE PREFERRED EMBODIMENT

Figure 1:
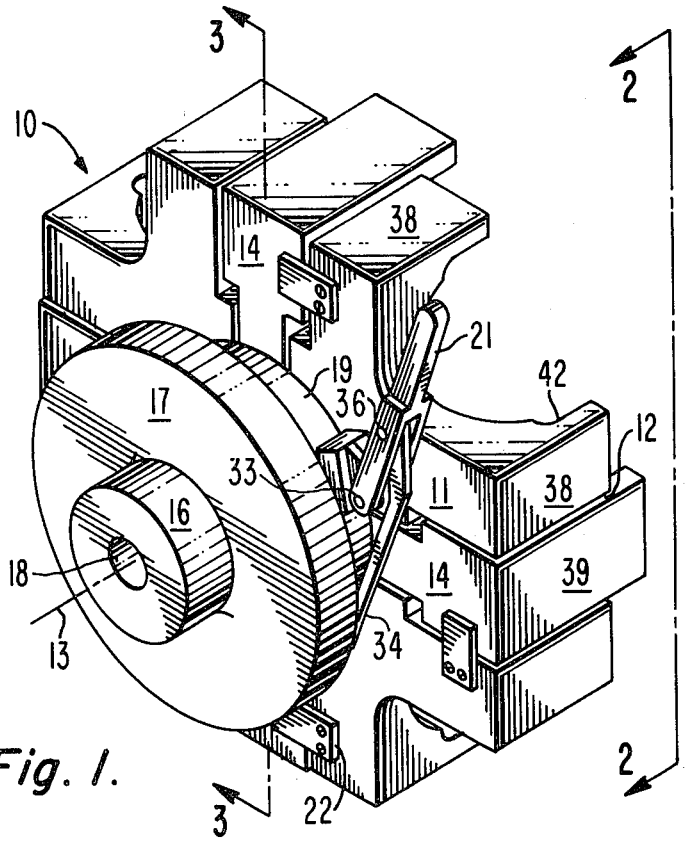
FIG. 1 is a perspective view of a preferred embodiment.

As shown in the FIGURES, the carrier 10 includes a support plate 11 having a plurality of radial slots 12 angularily spaced about the axis of rotation 13. Slidably arranged within the slots 12 are object retainers 14 which slide inwardly and outwardly normal to the axis 13.

A drive hub 16 is intregral with a mounting hub 17 both of which contain a bore 18 for mounting the carrier 10 to the rotatable shaft of a motor or gear mechanism. A tensioning band 19 is actuated by a lever arm 21 to bias the retainers 14 against an object being processed. As fully described hereinafter the actuation of the lever arm 21 urges the object retainers 14 inwardly toward the rotational axis 13 so that an object being processed is held by a constant known force which opposes the centrifugal force caused by rotation and the object being processed is not dropped.

Figure 2:
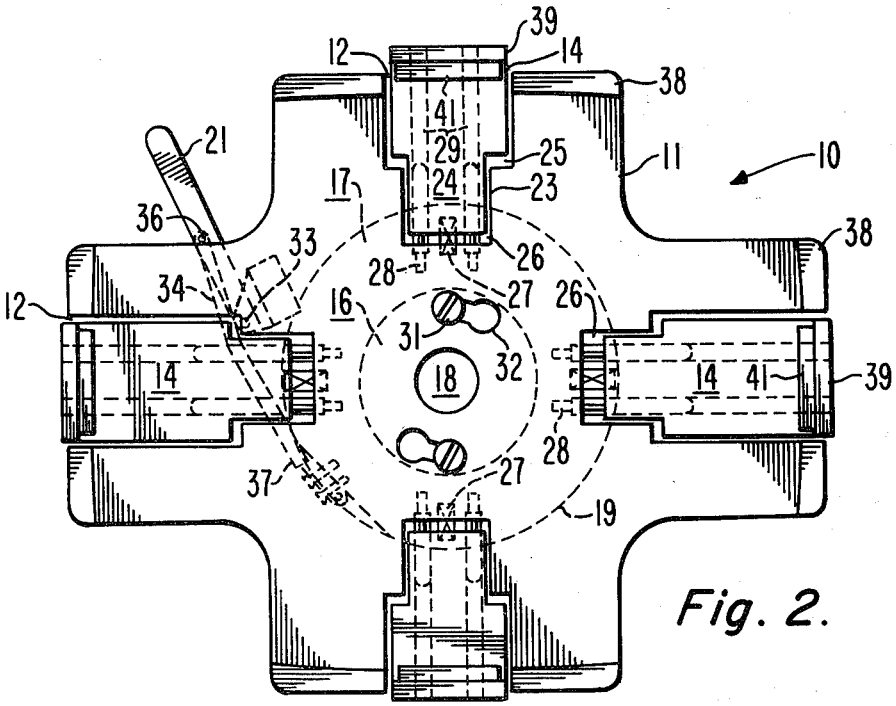
FIG. 2 is a front view taken along line 2—2 of FIG. 1.

As shown in the front view of FIG. 2, the support plate 11 is substantially cross-shaped with the slots 12 centered in the cross arms. The slots 12 have a narrow portion 23 toward the center of the carrier 10. The retainers 14 have corresponding narrow portions 24 which fit into the slots 23 with a close clearance compared to that of the wider portions of the slots 12 and retainers 14 to keep the slots and retainers in alignment. Clearances 25 and 26 are provided between the slots 12 and the retainers 14 so that the retainers are free to move radially inwardly a distance sufficient to allow the retainers to grip an object. Compression springs 27 bias the retainers 14 outwardly away from the axis of rotation 13. A plurality of guide pins 28 are threaded into the hub 17 and slide within bores 29 in the retainers 14. The guide pins 28 aid in keeping the retainers 14 properly oriented within the slots 12 while allowing radial movement in the plane of the guideplate 11. A plurality of pads 22 are affixed to the support plate 11 and extend over a portion of the slides 14. The pads 22 assist the pins 28 in keeping the slides 14 oriented in the plane of the support plate 11. A plurality of fasteners 31, such as screws, pass through slots 32 and holes 31*a* (FIG. 3) to hold the support plate 11 on the hub 16.

A tensioning handle 21 is attached to the backside of the support plate 11 at a pivot point 33. Pivotably coupled to the handle 21 at a pivot point 36 is a shaped lever arm 34, the free end 37 of which is coupled to the tensioning band 19. The combination of the handle 21 and the lever arm 34, therefore, form a dead over center lever action which is used to apply and release an inwardly directed force to the retainers 14 through the tensioning band 19.

Figure 3:
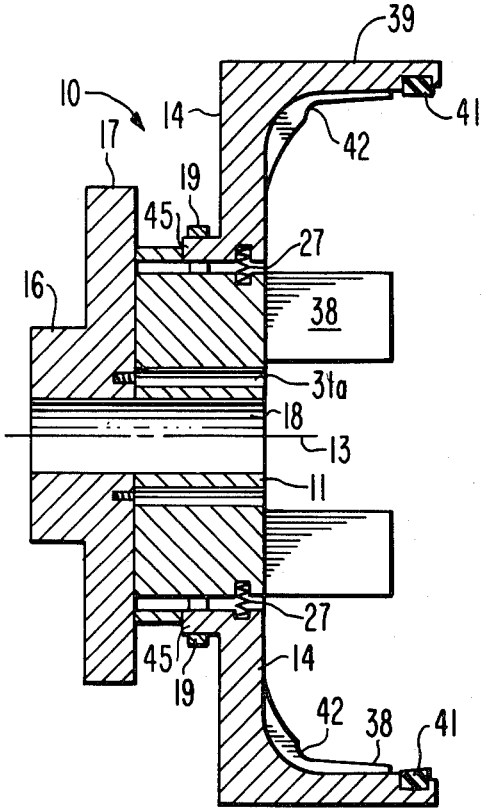
FIG. 3 is a cross-section taken along line 3—3 of FIG. 1.

As shown in FIG. 3, the retainers 14 include tensioning pads 45 which extend substantially parallel to the axis of rotation 13 and rearwardly away from the face of the support plate 11. The compression springs 27 bias the retainers 14 radially away from the axis of rotation 13 when the tensioning band 19 is loose around the tensioning pads 45. Moving the handle 21 and lever arm 34 to the closed position shown in FIG. 2 tightens the band 19 around the tensioning pads 45 and urges the retainers 14 against the compression springs 27 to firmly hold the object being processed. The maximum movement of the retainers 14 is determined by the clearances 25 and 26 and, therefore, a known maximum tension can be applied by selecting the circumference of the tensioning band 19. Also, if desired, a strain gauge can be used to determine the band tension.

As shown in FIGS. 1 and 2, the support plate 11 includes guides 38 which extend substantially perpendicular to the plane of the support 11 in a direction away from the mounting hub 16. Similarly, the retainers 14 are provided with guidefaces 39 which also extend substantially perpendicular to the support plate 11 in the same direction as the sides 38. Affixed to the guidefaces 39 are gripper pads 41 made of a resilient material, such as rubber, having a high coefficient of friction to hold an object to be processed without crushing the object and without the need for critical clearances. The guides 38 and the guide faces 39 are configured similarly to the edge of the object being processed to automatically orient the object being processed within the carrier 10. The inner surface of the resilient gripping pads 41 also are configured in accordance with the configuration of the edges of the object being processed.

In operation the object being processed is placed onto the support plate 11 between the guides 38. When the object being processed is a rectangular faceplate for a kinescope the faceplate rests along the curved portions 42 of the guides 38 so that the plane of the faceplate is substantially parallel to the plane of the support plate 11. The compression springs 21 bias the retainers 14 outwardly so that the faceplate to be processed freely fits between the resilient gripping pads 41. The handle arm 21 is closed and the tensioning band 19 acts against the tensioning pads 45 to urge the retainers 14 inwardly toward the axis of rotation 13 so that the gripper pads 41 apply a firm but noncrushing holding force to the edge of the faceplate. The faceplate is firmly held by the carrier 10 and dropping during rotation is minimized because centrifugal force acts against the constant force of the tensioning band 19. Additionally, the insertion and removal of faceplates from the carrier 10 are very rapid and simple but accurate alignment and centering of the faceplates with respect to the carrier are automatic. Additionally, changing the support plate 11 to accomodate different sizes of faceplates is readily accomplished during a nonrotating stage of processing simply by loosening the retaining screws 31 and slightly rotating the support plate 11 so that the screwheads fit through the enlarged holes 32 leaving the hubs 16 and 17 mounted on the shaft of the motor or gear mechanism.

What is claimed is:

1. A carrier for rotatably holding objects during processing comprising:

a support plate including a plurality of retention slots arranged at angular intervals about and substantially perpendicular to the axis of rotation of said plate, said plate having guides configured similarly to the object being processed and extending substantially parallel to the axis of rotation of said carrier to align said object in said carrier, the surface of said plate being configured similiarly to the face of said object to orient said object on said plate;

object retention means slidably arranged in said slots to slide substantially parallel to the plane of said support plate and including tensioning pads extending substantially parallel to the axis of rotation of said carrier;

biasing means arranged between said support plate and said retention means to bias said retention means away from the axis of rotation of said guide plate; and tension means for applying a constant predetermined force to said tensioning pads to urge said retention means against said biasing means toward the axis of rotation of said guide plate so that said retention means retain an object during rotation of said carrier and centrifugal force acts against said tensioning means.

2. The carrier of claim 1 wherein said retention means include guidefaces angularly disposed with respect to the plane of said support plate so that said guidefaces grip the edges of said object, said guidefaces being configured similarly to the edges of the object being processed so that said retention means centers and aligns the object with the plane of said support plate.

3. The carrier of claim 2 wherein said tensioning means includes a flexible band loosely engaging said tensioning pads and means for tightening said band to bias said guidefaces against the edge of the object being processed.

4. The carrier of claim 3 wherein said means for tightening is a dead-center lever arm for applying a constant predetermined force to said object being processed.

5. The carrier of claim 4 further including resilient gripping pads affixed to said guidefaces for engaging the edges of the object being processed.

* * * * *